US008884826B2

(12) United States Patent
Wu et al.

(10) Patent No.: US 8,884,826 B2
(45) Date of Patent: Nov. 11, 2014

(54) HOUSING OF PORTABLE ELECTRONIC DEVICE AND METHOD FOR MAKING THE SAME

(75) Inventors: Zhao-Yi Wu, Shenzhen (CN); Yong Yan, Shenzhen (CN); Yong-Fa Fan, Shenzhen (CN); Zhi-Guo Zhao, Shenzhen (CN); Jin-Rong Wang, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 764 days.

(21) Appl. No.: 12/967,151

(22) Filed: Dec. 14, 2010

(65) Prior Publication Data

US 2011/0316753 A1 Dec. 29, 2011

(30) Foreign Application Priority Data

Jun. 29, 2010 (CN) ..... 2010 1 0212561

(51) Int. Cl.
*H01Q 1/24* (2006.01)
*H01Q 1/40* (2006.01)
*H01Q 1/42* (2006.01)

(52) U.S. Cl.
CPC . *H01Q 1/42* (2013.01); *H01Q 1/40* (2013.01); *H01Q 1/243* (2013.01)
USPC ..... 343/702

(58) Field of Classification Search
USPC ..... 343/702, 873; 29/600
See application file for complete search history.

(56) References Cited

U.S. PATENT DOCUMENTS

| | | | | |
|---|---|---|---|---|
| 8,497,812 | B2 * | 7/2013 | Harokopus et al. | 343/872 |
| 2007/0187518 | A1 * | 8/2007 | Patrice | 235/492 |
| 2009/0115669 | A1 * | 5/2009 | Cheng | 343/702 |
| 2012/0319923 | A1 * | 12/2012 | Wu et al. | 343/873 |
| 2013/0076573 | A1 * | 3/2013 | Rappoport et al. | 343/702 |

FOREIGN PATENT DOCUMENTS

| | | | |
|---|---|---|---|
| CN | 1917282 | A | 2/2007 |
| CN | 101161726 | A | 4/2008 |

* cited by examiner

*Primary Examiner* — Tan Ho
(74) *Attorney, Agent, or Firm* — Novak Druce Connolly Bove + Quigg LLP

(57) ABSTRACT

A portable electronic device includes A portable electronic device includes a base, an antenna radiator, an outer layer, and at least one conductive contact. The antenna radiator formed on the base, the antenna radiator is made by injection molding from a mixture of materials selected from a group consisting of thermoplastic, organic filling substances, and conductive small particle sized material. The antenna radiator is sandwiched between the base and the outer layer. One end of each conductive contact is electrically connected to the antenna radiator, and the other end of the each conductive contact is exposed.

7 Claims, 7 Drawing Sheets

HOUSING OF PORTABLE ELECTRONIC DEVICE AND METHOD FOR MAKING THE SAME

This application is one of the three related co-pending U.S. patent applications listed below. All listed applications have the same assignee and were concurrently filed herewith. The disclosure of each of the listed applications is incorporated by reference into all the other listed applications.

| Title | Inventors |
|---|---|
| HOUSING OF PORTABLE ELECTRONIC DEVICE AND METHOD FOR MAKING THE SAME | Fan et al. |
| HOUSING OF PORTABLE ELECTRONIC DEVICE AND METHOD FOR MAKING THE SAME | Wu et al. |
| HOUSING OF PORTABLE ELECTRONIC DEVICE AND METHOD FOR MAKING THE SAME | Wu et al. |

BACKGROUND

1. Technical Field

The present disclosure relates to housings of portable electronic devices, especially to a housing having a three-dimensional antenna formed thereon and a method for making the housing.

2. Description of Related Art

Portable electronic devices, such as mobile phones, personal digital assistants (PDAs) and laptop computers are widely used. Most of these portable electronic devices have antenna modules for receiving and sending wireless signals. A typical antenna includes a thin metal radiator element mounted to a support member, and attached to a housing. However, the radiator element is usually exposed from the housing, and may be easily damaged. In addition, the radiator element and the support member occupy precious space. To solve this problem, a conductive ink is formed on the housing to form the antenna by a screen-printing method. However, this method is usually used to manufacture two-dimensional antennas, and the function of the antenna is limited.

Therefore, there is room for improvement within the art.

BRIEF DESCRIPTION OF THE DRAWINGS

Many aspects of the exemplary embodiment of a portable electronic device can be better understood with reference to the following drawings. The components in the drawings are not necessarily drawn to scale, the emphasis instead being placed upon clearly illustrating the principles of the portable electronic device. Moreover, in the drawings, like reference numerals designate corresponding parts throughout the several views, in which.

DETAILED DESCRIPTION

The disclosure is illustrated by way of example and not by way of limitation in the accompanying drawings. It should be noted that references to "an" or "one" embodiment in this disclosure are not necessarily to the same embodiment, and such references can include the meaning of "at least one" embodiment where the context permits.

Figure 1:
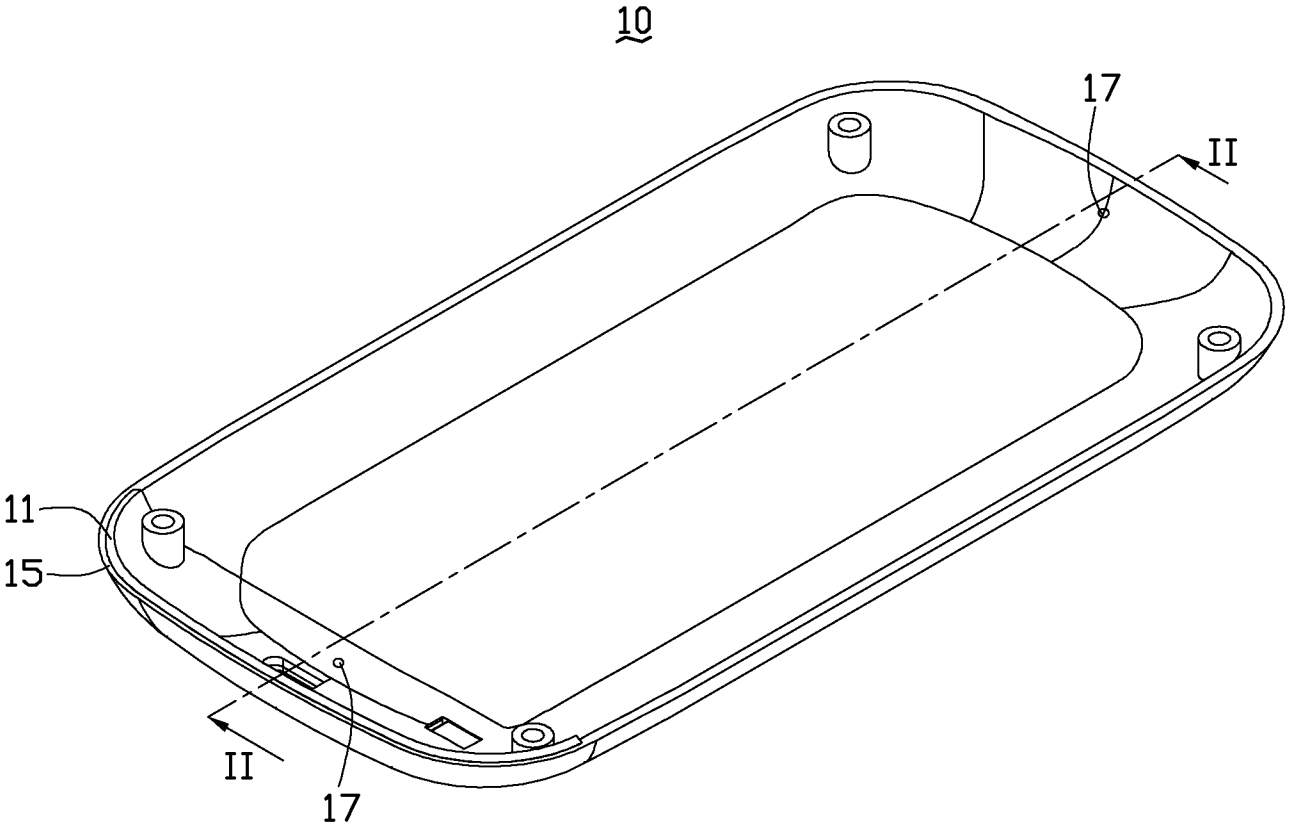
FIG. 1 is a schematic view of an exemplary embodiment of a housing of a first embodiment.

FIG. 1 shows a first embodiment of a housing 10 for an electronic device where an antenna is desired, such as a mobile phone, a PDA, and so on. The housing includes a base 11, an antenna radiator 13, an outer layer 15, and a number of conductive contacts 17. The antenna radiator 13 is a three dimensional antenna and is formed on the base 11 and is buried by the outer layer 15. The conductive contacts 17 are embedded in the housing 10 by insert-molding. One end of each conductive contact 17 is electrically connected to the antenna radiator 13, and the other end is exposed so that the electronic device can receive signals from the antenna radiator 13 or transmit signals by the antenna radiator 13.

Figure 2:
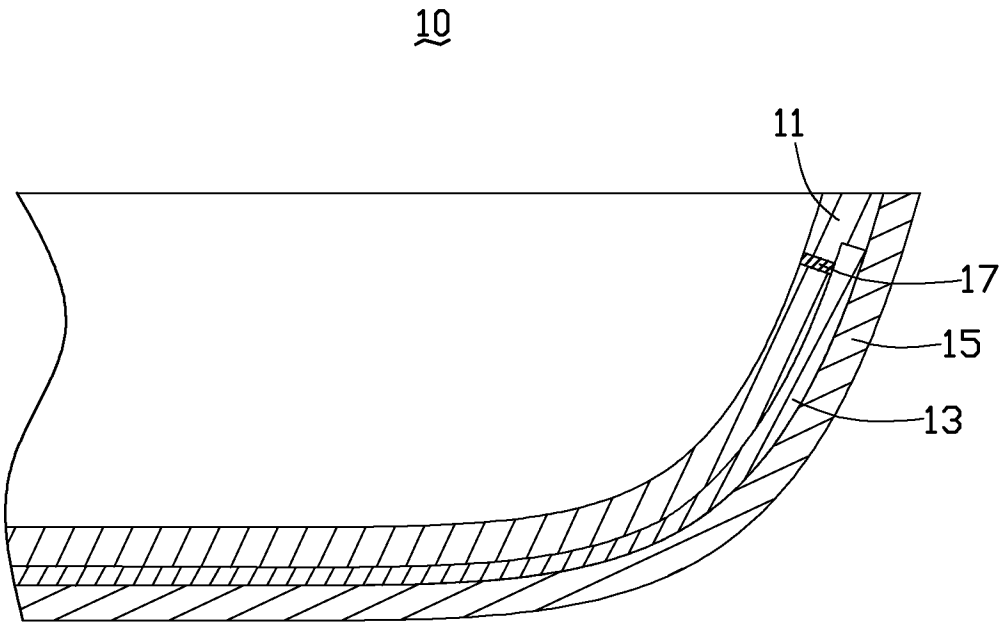
FIG. 2 is a cross-sectional view of a portion of the housing taken along line II-II of FIG. 1.

Referring to FIG. 2, the base 11 may be made of moldable plastic. The moldable plastic may be one or more thermoplastic materials selected from a group consisting of polypropylene (PP), polyamide (PA), polycarbonate (PC), polyethylene terephthalate (PET), and polymethyl methacrylate (PMMA).

The antenna radiator 13 is made of a mixture of materials selected from a group consisting of thermoplastic, organic filling substances, and conductive small particle sized material (i.e., material having a diameter that would be typically described using the dimension "nanometers". The resistivity of mixture is equal to or lower than $1.5\sim10\times10^{-8}\Omega\cdot m$ at 20° C. The mixture includes: the thermoplastic—65% to 75% by weight, the organic filling substances—22% to 28% by weight, and the non-conductive oxide—3% to 7% by weight. The thermoplastic can be made of polybutylene terephthalate (PBT) or polyesteramide (PI). The organic filling substances can be made of silicic acid and/or silicic acid derivatives.

The conductive small particle sized material may be nanoparticles of silver (Ag), gold (Au), copper (Cu), nickel (Ni), palladium (Pd), platinum (Pt), or alloy thereof. The particle diameter of the metal nanoparticles may be equal to or less than 75 nanometers (nm), with smaller particle sizes easing formation for injection. The conductive small particle sized material may also be conductive nanometer calcium carbonate, fabricated of calcium carbonate (CaCO3), tin (Sn), and antimony (Sb). The mass ratio of CaCO3:Sn:Sb is approximately 55~90:9~40:1~10, using nanometer sized calcium carbonate as nucleosome and forming tin dioxide doped with an antimony coating on the calcium carbonate surface by chemical co-deposition. The conductive small particle sized material may be carbon nanotubes. The particle diameter of the carbon nanotubes may be 20~40 nm, and the length of the carbon nanotubes may be 200-5000 nm. The conductive small particle sized material may further be carbon nanofiber, graphite nanofiber, or metal nanofiber. The particle diameter of the nanofibers may be 20~40 nm.

The outer layer 15 may be made of moldable plastic. The moldable plastic may be one or more thermoplastic materials selected from a group consisting of PP, PA, PC, PET, and PMMA.

Figure 3:
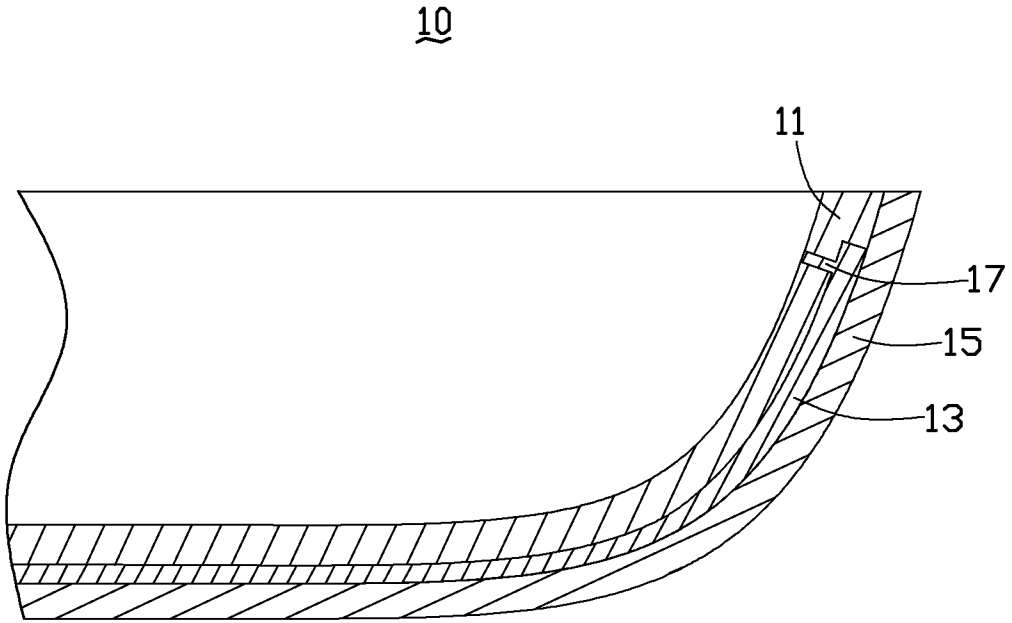
FIG. 3 is a cross-sectional view of a portion of a housing of a second embodiment.

Referring to FIG. 3, in the second embodiment, a housing 20 is similar to the housing 10 of the first embodiment, however, when the base 11 is injected, a number of through holes 16 are reserved, and the through holes 16 are filled with mixture of materials to form the antenna radiator 13.

Figure 4:
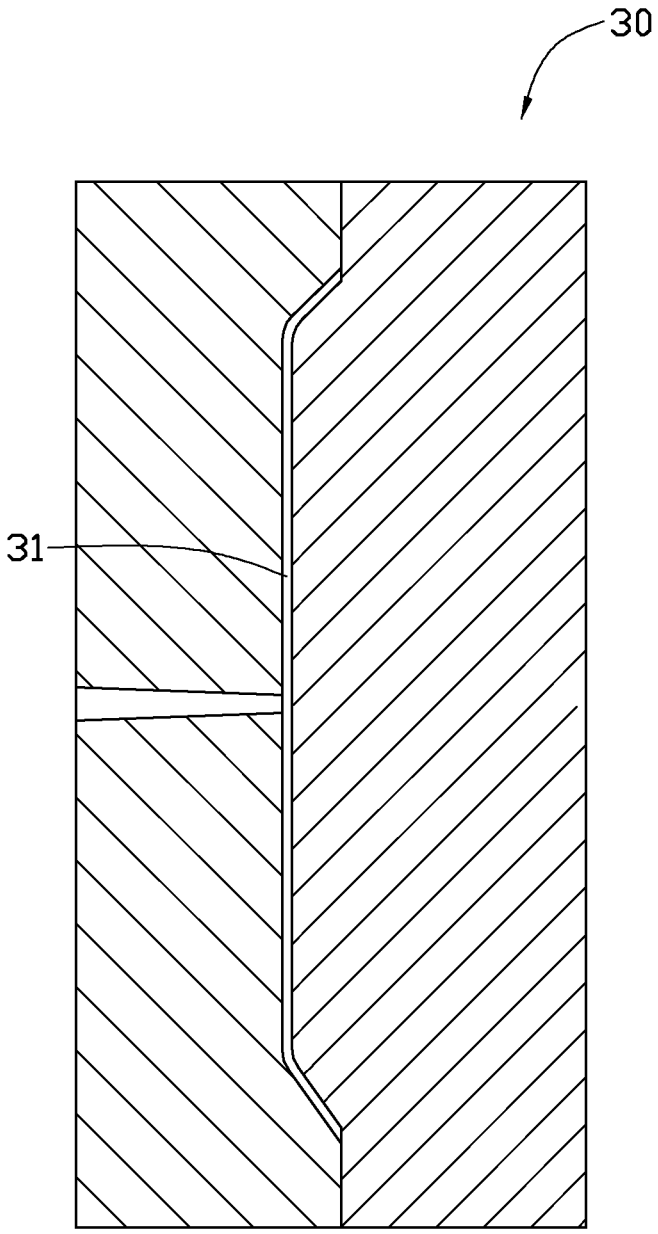
FIG. 4 is a cross-sectional view of one portion of a molding machine of making the housing of FIG. 1.

A first method for making the housing 10 of the first embodiment includes the following steps:

Referring to FIG. 4, an injection molding machine 30 is provided. The injection molding machine 30 is a multi-shot molding machine and includes a first molding chamber 31.

Figure 5:
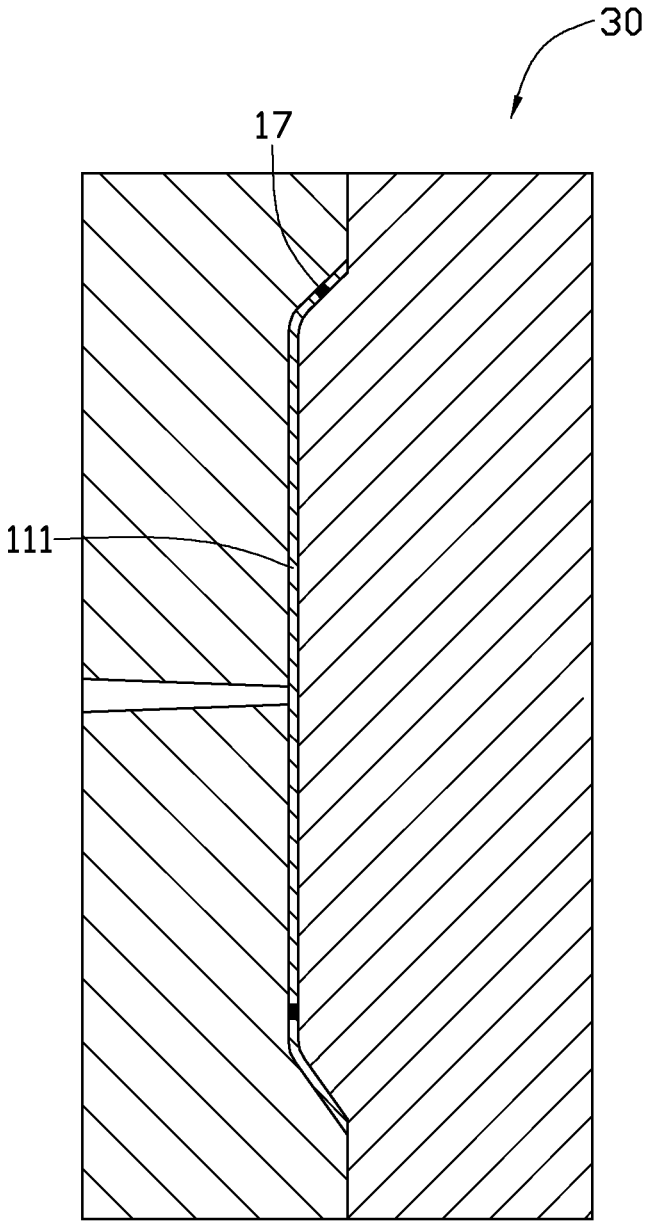
FIG. 5 is similar to FIG. 4, but showing a base formed.

Referring to FIG. 5, the conductive contacts 17 are placed in the injection molding machine 30, and the thermoplastic material is injected into the first molding chamber 31 to form the base 11. The moldable plastic may be one or more thermoplastic materials selected from a group consisting of PP, PA, PC, PET, and PMMA.

Figure 6:
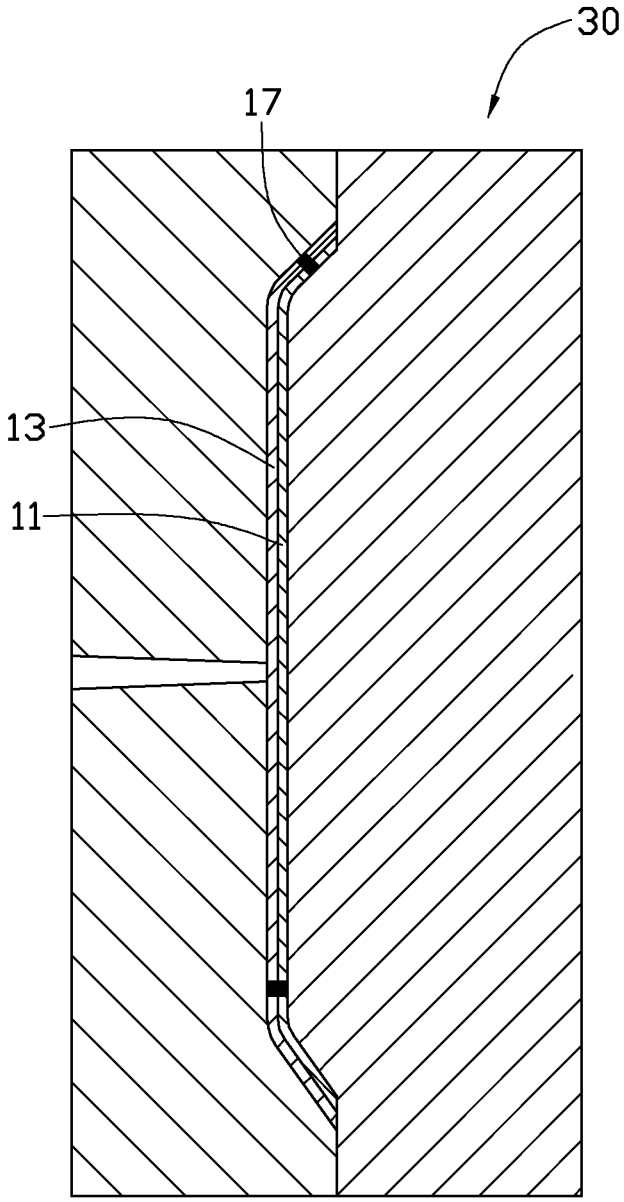
FIG. 6 is similar to FIG. 5, but showing an antenna radiator formed on the base.

Referring to FIG. 6, the mixture of materials selected from a group consisting of thermoplastic, organic filling substances, and conductive small particle sized material, is injected into the first molding chamber 31 to form the antenna radiator 13 covering at least one part of the base 11. The thermoplastic can be made of PBT or PI. The organic filling substances can be made of silicic acid and/or silicic acid derivatives. The conductive small particle sized material can be nanoparticles of metal, nanometer sized calcium carbonate, carbon nanotubes, or nanofibers, as described above.

Figure 7:
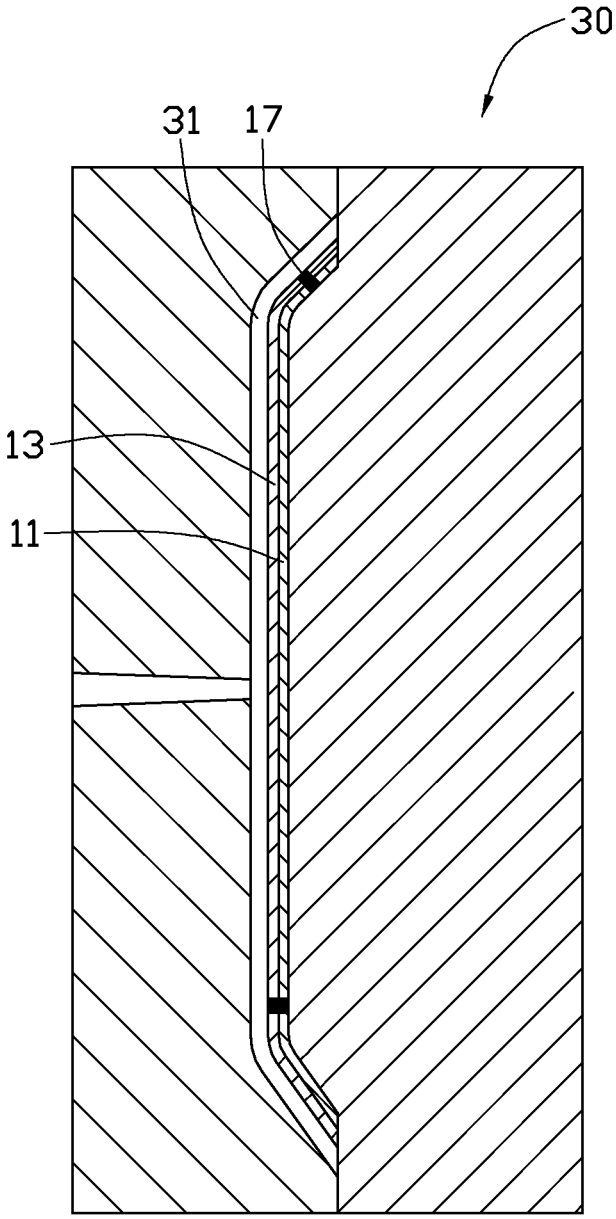
FIG. 7 is similar to FIG. 6, but showing an outer layer formed.

Referring to FIG. 7, the thermoplastic plastic is injected into the second molding chamber 31 to form the outer layer 15. Then, the outer layer 15 is attached to one side of the base 11 and buries the three-dimensional antenna radiator 13.

A second method for making the housing 20 is similar to the method of making the housing 10 as described above. However, when the base 11 is injected, a number of through holes 16 are reserved, and the through holes are filled with the conductive mixture when the antenna radiator 13 is injected.

The antenna radiator 13 is sandwiched between the base 11 and the outer layer 15 so that the antenna radiator 13 is protected from being damaged. In addition, the antenna radiator 13 can be directly attached to the housing 10, thus, the working efficiency is increased.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A housing comprising:

a base;

an antenna radiator formed on the base, the antenna radiator made of a mixture of materials selected from a group consisting of thermoplastic, organic filling substance, and conductive small particle sized material, the resistivity of mixture is equal to or lower than $1.5\sim10\times10^{-8}$ Ω·m at 20° C.;

an outer layer, the antenna radiator sandwiched between the base and the outer layer; and at least one conductive contact, one end of the at least one conductive contact electrically connected to the antenna radiator, and the other end of the at least one conductive contact exposed from the base.

2. The housing as claimed of claim 1, wherein the mixture includes the thermoplastic 65% to 75% by weight, the organic filling substances 22% to 28% by weight, the conductive small particle sized material 3% to 7% by weight.

3. The housing as claimed of claim 2, wherein the conductive small particle sized material is nanoparticles of silver, gold, copper, nickel, palladium, platinum, or alloy.

4. The housing as claimed of claim 2, wherein the conductive small particle sized material is calcium carbonate.

5. The housing as claimed of claim 2, wherein the conductive small particle sized material is carbon nanotube, the carbon nanotube, the particle diameter of the carbon nanotube is 20~40 nm, and the length of the carbon nanotube is 200-5000 nm.

6. The housing as claimed of claim 2, wherein the conductive small particle sized material is carbon nanofiber, graphite nanofiber, or metal nanofiber, the particle diameter of the nanofiber is 20~40 nm.

7. The housing as claimed of claim 1, wherein the organic filling substance is silicic acid and/or silicic acid derivatives.

* * * * *